United States Patent [19]

Seeger

[11] 4,423,759

[45] Jan. 3, 1984

[54] ELECTRICALLY POWERED LOG SPLITTER

[75] Inventor: Richard E. Seeger, Kittery Point, Me.

[73] Assignee: Armatron International, Inc., Melrose, Mass.

[21] Appl. No.: 316,885

[22] Filed: Oct. 30, 1981

[51] Int. Cl.[3] ..... B27L 7/00

[52] U.S. Cl. ..... 144/193 R; 144/366

[58] Field of Search ..... 144/193 R, 366, 3 K

[56] References Cited

U.S. PATENT DOCUMENTS

| | | | |
|---|---|---|---|
| 111,333 | 1/1871 | Ficht | 144/193 R |
| 4,121,636 | 10/1978 | James | 144/193 R |
| 4,141,395 | 2/1979 | Arzt | 144/193 R |
| 4,223,707 | 9/1980 | Jensen et al. | 144/193 R |

FOREIGN PATENT DOCUMENTS

| | | | |
|---|---|---|---|
| 231752 | 4/1944 | Switzerland | 144/193 R |

*Primary Examiner*—W. D. Bray

*Attorney, Agent, or Firm*—Thompson, Birch

[57] ABSTRACT

An electrically powered log splitter has a frame carrying a pair of mutually spaced fixed splitting components with a carriage mounted movable splitting component movable in opposite directions therebetween. A reversible electric drive motor is mechanically connected to the carriage to propel the carriage in opposite directions. A control switch is electrically connected between a power source and the drive motor. The switch has a first closed setting at which the drive motor is energized to move the carriage and its movable splitting component in one direction toward one of the fixed splitting components, a second closed setting at which the drive motor is energized to move the carriage and its movable splitting component in the opposite direction towards the other of the fixed splitting components, and a third normally open setting at which the drive motor is deenergized to halt movement of the carriage. An operating handle is provided to manually adjust the switch from its normally open third setting to either of its first or second closed settings. A shuttle rod is formed integrally with the operating handle and is engageable by the carriage to adjust the switch from either of its first or second closed settings to its normally open third setting in order to limit carriage movement in either direction. With minor modifications, essentially the same arrangement can be employed to operate a single-acting log splitter wherein the carriage mounted movable splitting component coacts with a single fixed splitting component.

16 Claims, 18 Drawing Figures

ELECTRICALLY POWERED LOG SPLITTER

BACKGROUND OF THE INVENTION

This invention relates generally to power operated log splitters.

Examples of known single-acting hydraulically powered log splitters are shown in U.S. Pat. Nos. 4,284,113 (Nordlin); 4,275,778 (Kotas); 4,103,724 (Braid); 3,242,955 (Hellstrom); and 3,077,214 (Brukner). The pumps, piston-cylinder assemblies and associated connecting lines and controls required for such splitters are relatively heavy, expensive and prone to leakage of hydraulic fluid.

Examples of known double-acting hydraulically powered log splitters are shown in U.S. Pat. Nos. 3,974,867 (Butas) and 3,319,675 (Bles). These double-acting versions suffer from the same drawbacks as mentioned above in connection with hydraulically powered single-acting splitters. Furthermore, because the piston-cylinder assemblies of double-acting splitters must of necessity be offset laterally from the axes of the logs being split, the resulting torques imposed on the seals and O-rings associated with said piston-cylinder assemblies further aggravate leakage problems. Also, because hydraulic pistons necessarily develop different forces during forward and reverse strokes due to the hydraulic displacement of the piston rods, the hydraulic systems of double-acting splitters must be oversized in order to achieve a stated minimum rating. This further increases the size, weight and cost of such systems.

As shown for example in U.S. Pat. Nos. 4,141,395 (Artz); 4,121,636 (James); 4,116,251 (Graney); 1,283,195 (Hunter); 1,189,999 (Peter); 111,333 (Ficht); and Swiss Pat. No. 231,752 (Suffert-Burner), it is well known to use mechanical threaded spindle or ratchet drives to power single-acting log splitters. However, such systems have not been employed previously in double-acting splitters, inspite of the advantages to be derived from doing do, as will hereinafter become more apparent.

SUMMARY OF THE PRESENT INVENTION

A general objective of the present invention is the provision of a double-acting log splitter having an improved electrically powered threaded spindle drive system.

A more specific object of the present invention is the provision of an improved low-cost operating arrangement for manually controlling and automatically limiting the operation of the electrically powered spindle drive system. Still another object of the present invention is the provision of an operating arrangement employing a single three-way normally open control switch which can be manually closed to operate the log splitter, and which is arranged to be automatically tripped to its normally open position at the end of each log splitting cycle.

In a preferred embodiment of the invention to be described hereinafter in greater detail, the log splitter includes a frame carrying a pair of mutually spaced fixed splitting components. A movable splitting component is mounted on a carriage which is shiftable in opposite directions along the length of the frame between the fixed splitting components. Preferably, the fixed splitting components comprise sharpened blades against which logs are driven by the movable splitting component. Alternatively, however, it would be possible to mount the blades in an oppositely facing arrangement on the carriage for coaction with opposed stationary contact faces fixed to the frame.

The carriage carries a nut which is threadedly engaged by a screw having at least one end rotatably and axially supported in bearings carried by the frame. The opposite end of the screw preferably extends in an unsupported cantilever fashion beyond the nut and carriage. A reversible drive is connected to the screw member at the end supported by the bearings.

The drive consists of a reversible electric motor having its output shaft arranged coaxially with and coupled to the screw member. The motor is controlled by a three-way control switch having a first closed setting at which the drive motor is energized to move the carriage in one direction towards one of the fixed splitting components, a second closed setting at which the drive motor is energized to move the carriage in the opposite directions towards the other of the fixed splitting components, and a third normally open setting at which the drive motor is deenergized to halt movement of the carriage. In addition to being manually adjustable by an operator, the control switch is also arranged to be automatically tripped to its normally open third setting as the carriage arrives at the end of its travel towards either of the fixed splitting components.

DETAILED DESCRIPTION OF PREFERRED EMBODIMENT

Figure 1:
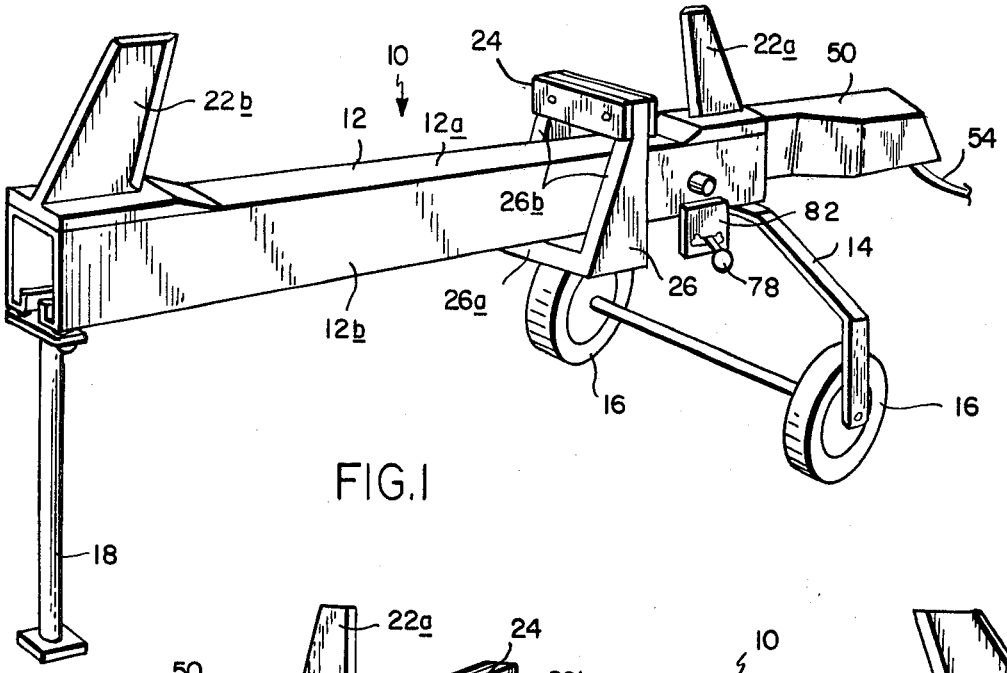
FIG. 1 is a perspective view showing one side of a log splitter in accordance with the present invention.

Referring now to the drawings, a preferred embodiment of a double-acting log splitter in accordance with the present invention is generally indicated at 10. The log splitter has a longitudinally extending frame 12 supported at one end by a bracket 14 with wheels 16 at its lower end, and at the opposite end by a single leg 18. The frame has a top wall **12*a*, opposed depending side walls 12*b* and inwardly extending bottom flanges 12*c* spaced one from the other to define a slot 20 extending along the underside of the frame. A pair of fixed splitting components, in this case confronting sharpened blades 22***a*, 22*b*, are spaced along the length of and are mounted on the top wall 12*a* of the frame member 12. A movable splitting component 24 is carried on a carriage 26 which is shiftable in opposite directions along the length of the frame 12 between the fixed splitting components 22*a*, 22*b*.

The carriage 26 comprises a unitary casting having a base 26*a* underlying the inturned bottom flanges 12*c* of the frame member 12. Sides 26*b* extend upwardly from the base 26*a* externally along the frame side walls 12*b*. The movable splitting component 24 extends between and is fixed to the upper ends of the sides 26*b* at a location transversally overlying the frame top wall 12*a*. The carriage 26 further includes a trough-shaped cradle 26*c* located between the frame side walls 12*b*. The cradle 26*c* is connected to the base 26*a* by an intermediate web 26*d* extending vertically through the slot 20.

Slide members 28 are connected to the cradle 26*c* by pins 30 and bushings 32 for limited pivotal movement about axes extending transversally in relation to the direction of carriage movement, which coincides of course with the longitudinal axis of the frame member 12. The slide members 28 are arranged to be captured between and to slidably contact the frame top wall 12*a* and L-shaped liners 34 on the inturned flanges 12*c*.

The cradle 26*c* is adapted to receive a nut 36 which forms part of the mechanism for shifting the carriage 26 to and fro. The cradle fixes the nut against axial movement relative to the carriage, while at the same time allowing for limited lateral play to develop between the nut and cradle. A drive screw 38 is threaded through the nut 36. One end of the drive screw is fixed axially by and rotatably supported in a pair of bearings 40*a*, 40*b* retained in interconnected front and rear drive housings 42, 46, these housings being fixed relative to the frame 12 rearwardly of the fixed splitting component 22*a*. The opposite end of the drive screw preferably extends in an unsupported cantilever fashion beyond the nut 36 and carriage 26.

The drive screw 38 is rotatably driven by a reversible drive which preferably comprises an electric motor 48 secured to the rear drive housing 46 beneath a protective cover 50. The output shaft 52 of motor 48 is aligned axially with and is coupled to the drive screw 38 rearwardly of the bearings 40*a*, 40*b*.

Figure 3:
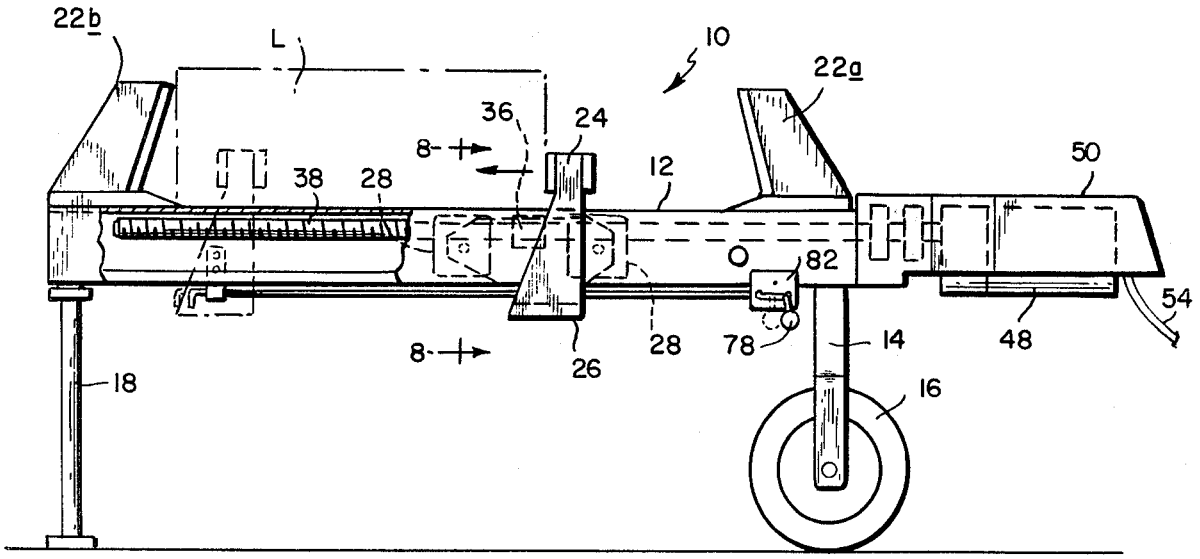
FIG. 3 is a side elevational view of the log splitter, with a portion of the frame broken away.
Figure 6:
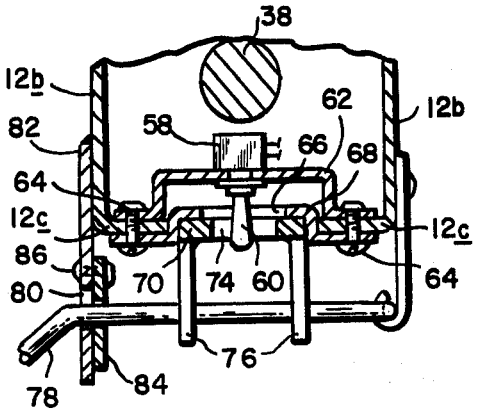
FIGS. 6 and 7 are sectional views taken along lines 6—6 and 7—7 of FIG. 4.
Figure 8:
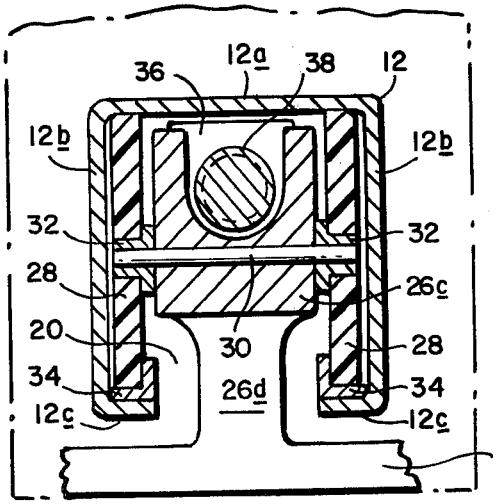
FIG. 8 is a cross sectional view on an enlarged scale taken along line 8—8 of FIG. 3.

With this arrangement, when the motor 48 is energized to rotate the drive screw 38 in one direction (for example the counter-clockwise direction as viewed in FIG. 6), the carriage 26 will be driven in one direction towards the blade 26*b*, and a log "L" positioned as shown by the dot-dash lines in FIG. 3 will be split by being forced against the blade 26*b* by the movable splitting component 24. Once this has been accomplished, another log can be placed between the opposite side of the movable splitting component 24 and the other fixed blade 22*a*, and by energizing the motor 48 to rotate the drive screw 38 in the opposite direction, a second splitting operation will take place as the carriage is returned in the opposite direction.

Figure 11:
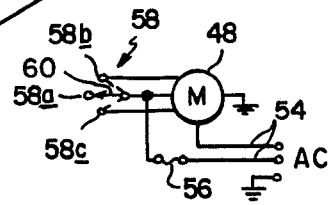
FIG. 11 is an electrical schematic.
Figure 5:
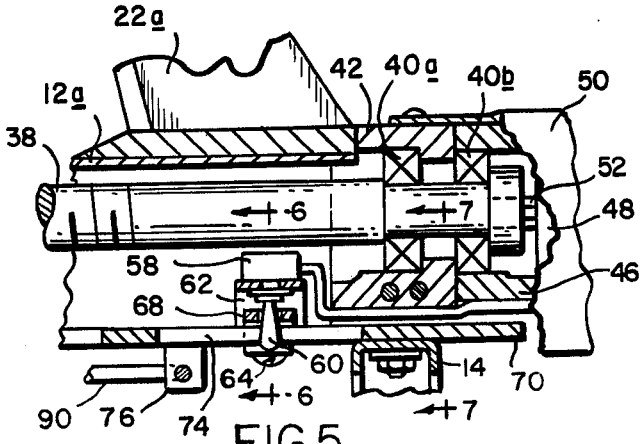
FIG. 5 is an enlarged elevational view of the log splitter with the frame and other external components broken away and with internal components sectioned in order to show the control switch and its associated operating components assembled in place.

Any appropriate means such as for example a flexible power cord 54 is provided for connecting the motor 48 to any standard A.C. power source. As shown schematically in FIG. 11, the cord 54 is connected to the motor via a circuit breaker 56 to safeguard against damaging overloads, and a three-way normally open control switch 58 having a pivotal switch lever 60.

The switch 58 is mounted within the frame 12 on a bracket 62 secured by bolts 64 to the bottom frame flanges 12*c*. The switch lever 60 protrudes downwardly through a slot 66 in an underlying guide plate 68 which is also secured to the frame flanges 12*c* by the same bolts 64.

Figure 7:
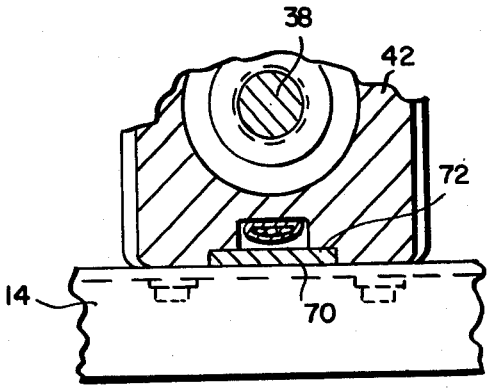

A switch cam plate 70 is located on the underside of the guide plate 68. The guide plate 68 is generally U-shaped in cross section to provide a guide channel aligned with a guide channel 72 (See FIG. 7) in the bottom of the front drive housing 42. The cam plate 70 is held in these guide channels by the wheel bracket 14 and is slidably movable in opposite directions parallel to the direction of carriage movement along the frame 12.

Figure 9A:
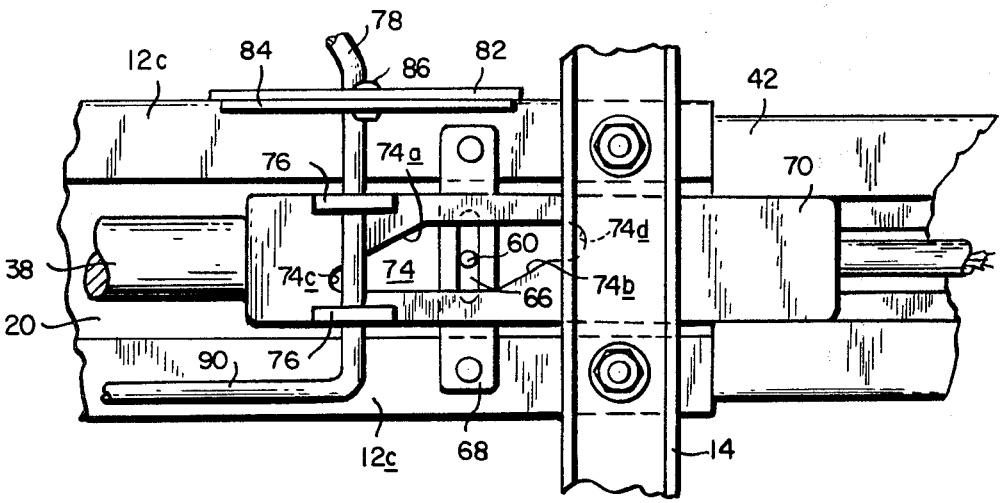
FIGS. 9A–9C are enlarged partial bottom views of the log splitter showing the control switch and its associated operating components at different settings.

The cam plate has an opening 74 into which protrudes the switch lever 60. The central portion of the opening 74 is large enough to accommodate free movement of the lever 60 to its normally open intermediate position, as shown in FIG. 9A. The opening is partially bounded by cam edges 74*a*, 74*b* leading respectively to end notches 74*c*, 74*d*.

Cam plate 70 is further provided with depending lugs 76 having aligned openings arranged to receive an operating handle 78. Handle 78 protrudes laterally from beneath the frame 12 through a horizontal slot 80 in a guide plate 82 secured to the frame. The slot 80 has vertically protruding notches 80*a*, 80*b* adjacent its opposite ends 80*c*, 80*d*.

Figure 12:
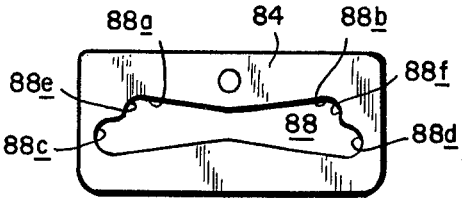
FIG. 12 is a side elevational view of the operating handle control plate.

A control plate 84 is pivotally attached to the back side of the guide plate 82 by means of a pin 86. As is best shown in FIG. 12, the control plate 84 has a shaped slot 88 with vertically protruding notches 88*a*, 88*b* adjacent its opposite ends 88*c*, 88*d*. The notches 88*a*, 88*b* are separated from their respective slot ends 88*c*, 88*d* by stop shoulders 88*e*, 88*f*.

Figure 4:
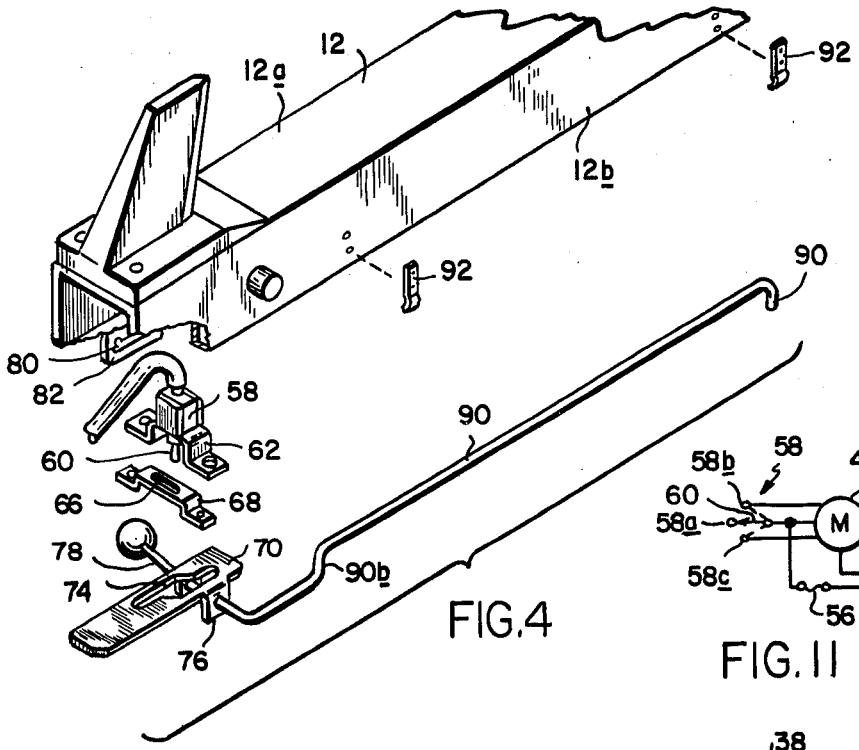
FIG. 4 is an exploded perspective view showing the control switch and its associated operating components.

The control handle 78 is formed integrally as part of a shuttle rod 90 which extends along the underside of the frame 12. The shuttle rod is supported for slidable movement in opposite directions parallel to the direction of carriage movement by means of brackets 92 secured to one side 12*b* of the frame 12. As can be best seen in FIGS. 2 and 4, the shuttle rod has a hooked end 90*a* which is engageable by the carriage 26 as it reaches the end of its travel towards fixed blade 22*b*, and a bent portion 90*b* which is engageable by the carriage as it reaches the end of its travel in the opposite directions towards fixed blade 22*a*.

The log splitter of the present invention operates in the following manner:

STOP CONDITION

Figure 10A:
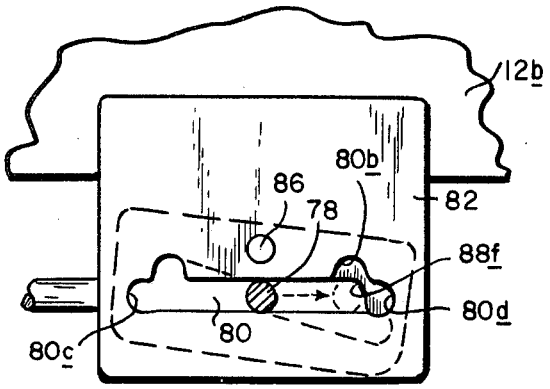
FIGS. 10A–10E are views showing how the control handle is manipulated to achieve the different control switch settings.

When in the stop condition, the operating handle 78 and the switch cam plate 70 are positioned as shown in FIGS. 9A and 10A. The switch lever 60 is in an intermediate position, causing the switch 58 to be set to its normally open position indicated at 58*a* in FIG. 11. The motor 48 is thus de-energized, and all splitter components are at rest.

SPLITTING CYCLE (24/22*b*)

Figure 2:
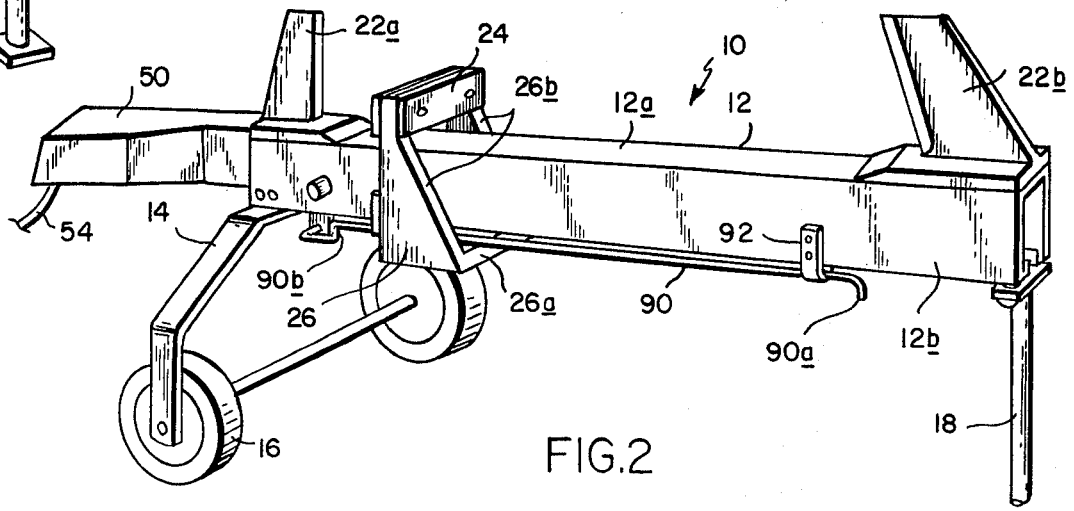
FIG. 2 is a perspective view showing the other side of the same log splitter.
Figure 9B:
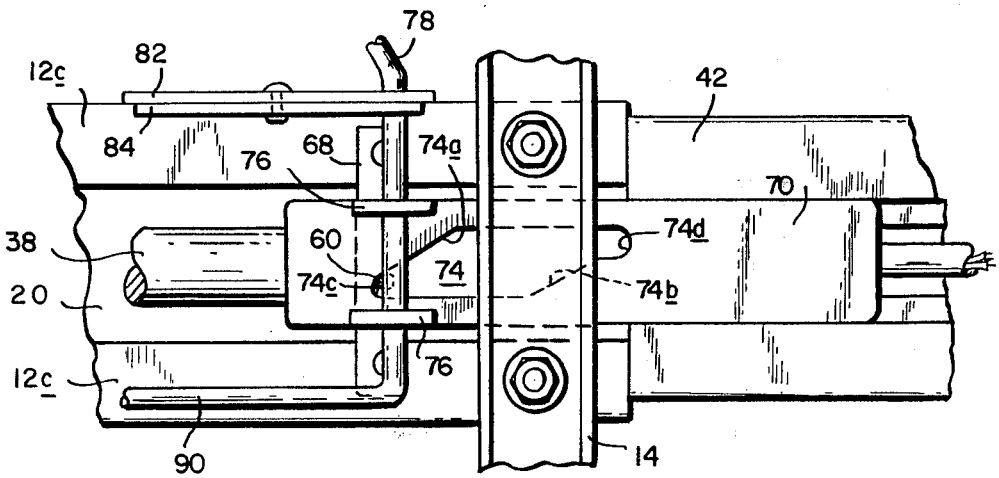
Figure 10B:
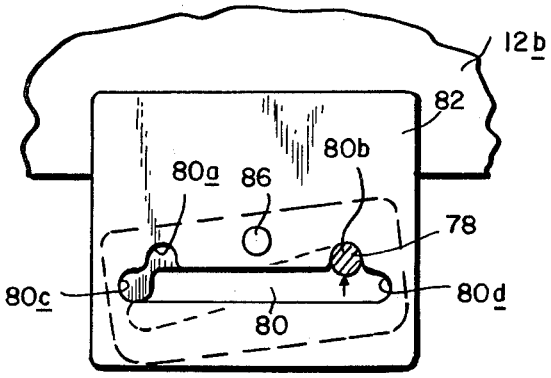
Figure 10C:
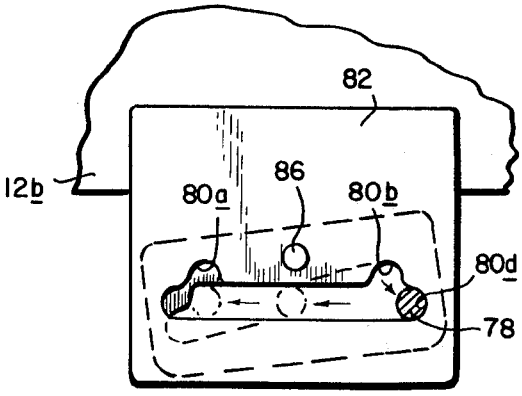

Assuming that the carriage 26 is in the position shown in FIGS. 1 and 2, a log is then placed longitudinally on the top surface 12*a* of frame 12 between the movable splitting component 24 and the fixed blade 22*b*. The operating handle 78 is then manually shifted in the direction indicated by the arrow in FIG. 10A until it engages the stop shoulder 88*f* of the pivotally inclined control plate 84. At this point, the switch 58 remains open and the motor 48 remains de-energized. This feature precludes accidental energization of motor 48 by simply shifting the position of handle 78 along the length of slot 80. The operator must then raise the operating handle in the direction indicated by the arrow in FIG. 10*b* in order to pivotally adjust the control plate 84 so as to clear its stop shoulder 88*f* from the slot 80 and thereby bring the slot ends 88*d* and 80*d* into registration. Once this has been accomplished, the control handle can be manually shifted in the direction of the arrow in FIG. 10*c* to a closed position at the slot end 80*d*. This produces a shifting of the switch cam plate 70 to the position shown in FIG. 9B. As this occurs, the cam edge 74*a* engages the switch lever 60 and shifts it laterally, thereby causing the switch 58 to be adjusted to the closed setting 58*b* shown in FIG. 11. This energizes motor 48 with the results that the carriage 26 is advanced towards the stationary blade 22*b*. The movable splitting component 24 drives the log against the fixed blade 22*b*, causing splitting. The carriage 26 continues to move towards the fixed blade 22*b* until the carriage base 26*a* engages the hooked end 90*a* of shuttle rod 90. When this occurs, the shuttle rod is advanced in the direction of carriage movement, and this in turn causes the switch cam plate 70 to be returned to its neutral position as shown in FIG. 9*a*. The switch lever 60 thus returns to its intermediate position, resetting the switch 58 to its normally open position 58*a* and de-energizing motor 48. At this point in time, the control handle has been shifted to the position indicated by broken lines at 78′ in FIG. 10*c*.

SPLITTING CYCLE (24/22*a*)

Figure 9C:
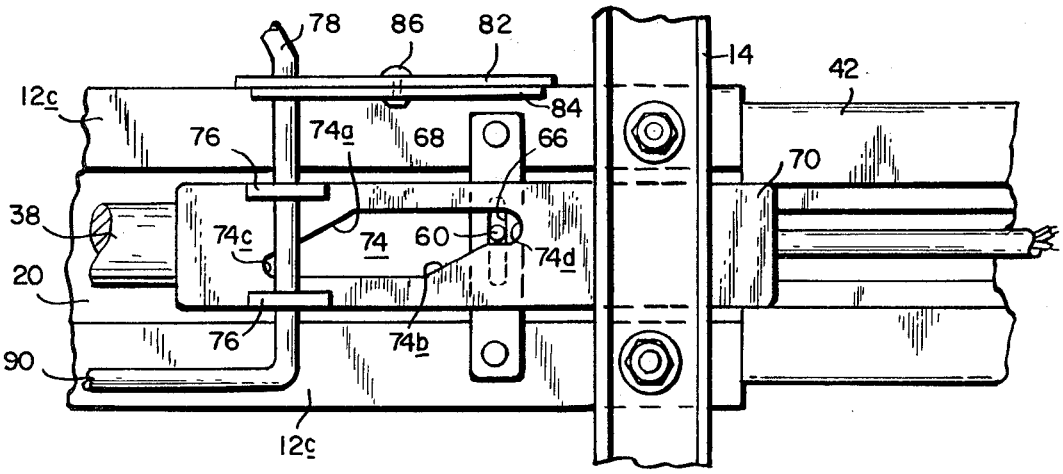
Figure 10D:
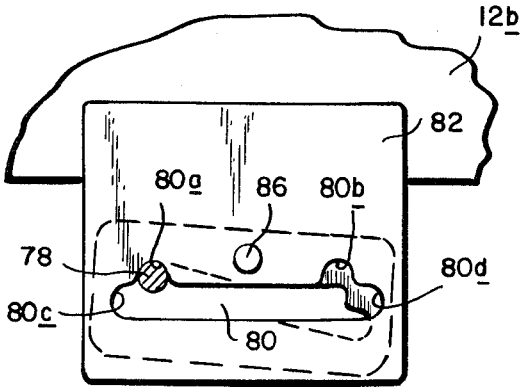
Figure 10E:
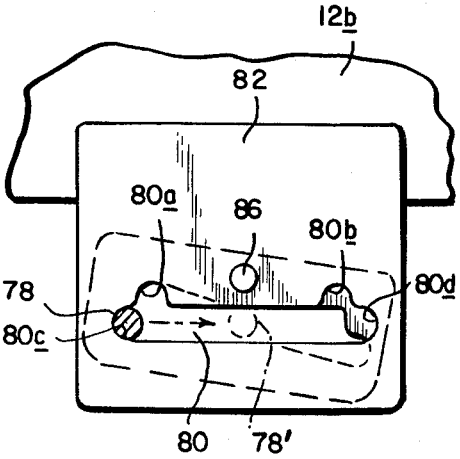

Another log can then be placed longitudinally on the top surface 12*a* of frame 12 between the movable splitting component 24 and the fixed blade 22*a*. Referring again to FIG. 10C, the operator then shifts the control handle from the intermediate position 78′ towards the end 80*c* of slot 80. The operating handle will engage the stop shoulder 88*e* of control plate 84, thus requiring the operator to raise the control handle to the position shown in FIG. 10D in order to pivotally readjust the control plate 84. Once this has been accomplished, the operating handle can be shifted to the end 80*c* of slot 80, thus shifting the switch cam plate 70 to the position shown in FIG. 9*c*. The switch lever 60 is thus biased laterally by the cam edge 74*b*, causing the switch 58 to be adjusted to its alternate closed setting as shown at 58*c* in FIG. 11. This energizes motor 48 and causes the carriage 26 to move towards fixed blade 22*a*. A log positioned between movable splitting component 24 and fixed blade 22*a* will thus be split, and carriage movement towards blade 22*a* will continue until the carriage base 26*a* engages the bent portion 90*b* of shuttle rod 90. When this occurs, the shuttle rod and switch cam plate 70 will be returned to the neutral position shown in FIG. 9A, thus readjusting the switch 58 to its normally open setting 58*a* to de-energize the motor 48. The control handle 78 will thus be shifted in the direction of the arrow in FIG. 10E to the neutral position shown by broken lines at 78′.

In light of the foregoing, it will now be appreciated that the present invention provides a simple yet highly effective means of controlling the operation of an electrically powered double-acting log splitter. All functions are manually controlled through the use of a single normally open three-way control switch. The control switch is arranged to be automatically tripped to its normally open position at the end of each splitting cycle.

Inadvertent energization of the drive motor is prevented by the cooperative interrelationship of the pivotal control plate 84 and the stationary guide plate 82.

Although the invention has been described in connection with a double-acting splitter, it will be understood by those skilled in the art that with minor modifications, the invention can be adapted to control the operation of an electrically powered spindle-driven single-acting splitter where the movable splitting component coacts with a single fixed splitting component.

I claim:

1. In a log splitter having a longitudinally extending frame, at least one fixed splitting component mounted on said frame, a movable splitting component mounted on a carriage which is movable on said frame in opposite directions to coact with said fixed splitting components in splitting logs positioned therebetween, and a reversible electric drive motor adapted to be connected to and to be powered by an electrical power source, said drive motor being operable to propel said carriage in said opposite directions, the improvement comprising:

a control switch electrically connected between said power source and said drive motor, said switch having a first closed setting at which said drive motor is energized by said power source to propel said carriage in one direction towards said fixed splitting component, a second closed setting at which said drive motor is energized by said power source to propel said carriage in the opposite direction away from said fixed splitting component, and a third normally open setting at which said drive motor is deenergized to halt carriage movement;

and operating means for manually adjusting said switch from said third normally open setting to either of said first or second closed settings, said operating means being additionally operative in response to movement of said carriage to adjust said switch from either of said first or second closed settings, to said third normally open setting in order to limit the movement of said carriage in either of said directions.

2. The apparatus of claim 1 wherein said control switch has a lever which is movable between first, second and third positions in order to adjust said switch to said first, second and third settings.

3. The apparatus of claim 2 wherein said operating means includes a cam plate movable in relation to said lever and engageable therewith to adjust said lever between said first, second and third positions, and a shuttle rod connected to said cam plate, said shuttle rod being movable in the direction of carriage movement and having portions thereof engageable by said carriage.

4. The apparatus of claim 3 wherein said cam plate is movable in the direction of carriage movement.

5. The apparatus of claims 3 or 4 wherein said lever protrudes into an opening in said cam plate, said opening being bounded by first and second cam edges which are arranged respectively to engage and shift said lever to said first and second positions, the said opening having an area intermediate said first and second cam edges which is appropriately dimensioned to accommodate movement of said lever to said third position.

6. The apparatus of claim 3 further comprising a control handle for manually shifting said cam plate in relation to said switch lever.

7. The apparatus of claim 6 wherein said control handle is formed integrally with said shuttle rod.

8. In a double acting log splitter having a longitudinally extending frame, a pair of first splitting components spaced along the length of and fixed to said frame, a second splitting component mounted on a carriage which is movable on said frame in opposite directions between said first splitting components, and a reversible drive motor adapted to be connected to and to be powered by an electrical power source, said drive motor being operable to propel said carriage in said opposite directions, the improvement comprising:

a control switch electrically connected between said power source and said drive motor, said switch having a first closed setting at which said drive motor is energized by said power source to propel said carriage in one direction towards one of said first splitting components, a second closed setting at which said drive motor is energized by said power source to propel said carriage in the opposite direction towards the other of said first splitting components, and a third normally open setting at which said drive is deenergized to halt carriage movement;

and operating means for manually adjusting said switch from said third normally open setting to either of said first or second closed settings, said operating means being additionally operative in response to movement of said carriage to adjust said switch from either of said first or second closed settings, to said third normally open setting in order to limit the movement of said carriage in either of said directions.

9. A double acting log splitter comprising in combination: a frame carrying a pair of mutally spaced fixed splitting members; a carriage mounted on said frame for movement in opposite directions between said fixed splitting components, said carriage carrying a movable splitting component arranged to cooperate alternately with either of said fixed splitting components to split a log positioned longitudinally therebetween; a reversible electric drive motor adapted for connection to an electrical power source, said motor being mechanically connected to said carriage and being operative to propel said carriage in said opposite directions; a control switch electrically connected between said power source and said drive motor, said switch having a first closed setting at which said drive motor is energized by said power source to move said carriage in one direction towards one of said first splitting components, a second closed setting at which said drive motor is energized by said power source to move said carriage in the opposite direction towards the other of said first splitting components, and a third normally open setting at which said drive motor is deenergized to halt movement of said carriage; first operating means for manually adjusting said switch from said normally open third setting to either of said first or second closed settings in order to move said carriage in a desired direction; and second operating means responsive to movement of said carriage for adjusting said switch from either of said first or second closed settings to said normally open third setting in order to limit carriage movement in either direction.

10. The log splitter of claim 9 wherein said switch has a lever which is movable between first, second and third positions corresponding respectively to said first, second and third settings.

11. The log splitter of claim 10 further comprising a cam plate movable by said first and second operating means in the direction of carriage movement, said cam plate having cam surfaces arranged to coact with said lever in adjusting said switch to either of said first, second or third settings.

12. The log splitter of claim 11 wherein said first operating means comprises a handle mechanically connected to said cam plate.

13. The log splitter of claim 12 wherein said second operating means comprises a shuttle rod movable in the direction of carriage movement, said shuttle rod being mechanically connected to said cam plate and having portions thereof engageable by said carriage at locations adjacent to the end of carriage travel in either of said opposite directions.

14. The log splitter of claim 12 wherein said handle and said shuttle rod are integrally formed as a single unit.

15. The log splitter of claim 9 wherein said first operating means includes a handle manually adjustable in the direction of carriage movement between a third intermedite position at which said switch is in said third normally open setting, and first or second positions at which said switch is respectively at said first or second settings.

16. The log splitter of claim 15 further comprising means for requiring said operating handle to be moved in a direction transverse to the direction of carriage movement as a preliminary step to moving said handle into either of said first or second positions from said third position.

* * * * *